US005789637A

United States Patent [19]

Mignard et al.

[11] Patent Number: 5,789,637

[45] Date of Patent: Aug. 4, 1998

[54] PROCESS FOR THE HYDROGENATION OF AROMATIC COMPOUNDS COMPRISING CHLORINE INJECTION, USING CATALYSTS BASED ON A NOBLE METAL

[75] Inventors: Samuel Mignard, Chatou; Virginie France Harle; Slavik Kasztelan, both of Rueil Malmaison; Nathalie Marchal-George, Paris, all of France

[73] Assignee: Institut Francais du Petrole, France

[21] Appl. No.: 671,501

[22] Filed: Jun. 27, 1996

[30] Foreign Application Priority Data

Jun. 27, 1995 [FR] France ..... 95 07726

[51] Int. Cl.[6] ..... C07C 5/10; C10G 45/52

[52] U.S. Cl. ..... 585/269; 585/266; 585/268; 585/277; 208/143; 208/144; 208/145

[58] Field of Search ..... 208/143, 144, 208/145; 585/266, 268, 264, 277

[56] References Cited

U.S. PATENT DOCUMENTS

| | | | |
|---|---|---|---|
| 3,639,227 | 2/1972 | Jacobson et al. | 208/143 |
| 3,816,299 | 6/1974 | Mears | 208/143 |
| 3,954,601 | 5/1976 | Cosyns et al. | 208/143 |
| 4,115,255 | 9/1978 | Hayes et al. | 208/143 |

*Primary Examiner*—Glenn Caldarola
*Assistant Examiner*—Thuan D. Dang
*Attorney, Agent, or Firm*—Millen, White, Zelano & Branigan, P.C.

[57] ABSTRACT

The invention concerns a process for the hydrogenation of aromatic compounds contained in feeds with an initial boiling point of more than 100° C. and which contain at least 10% by weight of aromatic compounds. It consists of introducing chlorine in a concentration of 0.5–500 ppm by weight with respect to the feed at a temperature of between 200° C. and 450° C., a pressure in the range 1 MPa to 25 MPa, an HSV of between 0.1 $h^{-1}$ and 10 $h^{-1}$ and a volume ratio of hydrogen to feed of 100–2000. The catalyst used is a noble metal type and contains less than 1% of at least one halogen. Preferably, the catalyst is fluorinated or chlorinated.

23 Claims, No Drawings

PROCESS FOR THE HYDROGENATION OF AROMATIC COMPOUNDS COMPRISING CHLORINE INJECTION, USING CATALYSTS BASED ON A NOBLE METAL

FIELD OF INVENTION

The invention concerns a process for the hydrogenation of aromatic compounds in the presence of a catalyst based on a noble metal and in the presence of chlorine.

BACKGROUND OF INVENTION

Specifications concerning the concentration of aromatic compounds in gas oils will be coming into force in the future.

At the moment, desulphurizing units for this type of feed are not capable of satisfactorily hydrogenating aromatic compounds at the same time.

It is thus highly probable that in the future, new types of units will be developed which will not only carry out intensive desulphurization but will also carry out high efficiency hydrogenation of the aromatic compounds.

These new units may be constituted by two reaction zones. The first reaction zone (which may be a reactor) will reduce the concentration of sulphur to a low value. Then the second reaction zone will hydrogenate the aromatic compounds present in the effluents from the first zone. Catalysts based on noble metals are the best hydrogenation catalysts. Unfortunately, catalysts based on noble metals are usually extremely sensitive to the presence of sulphur.

Our research has led us to explore the possibility of adding chlorine to a feed which may optionally have been desulphurized to increase the hydrogenating activity of the catalyst. Chlorine injection may be continuous or otherwise depending on the desired level of activity.

U.S. Pat. Nos. 3,639,227 and 3,816,299 describe processes for the hydrogenation of aromatic compounds in the presence of chlorine.

U.S. Pat. No. 3 816 299 describes the addition of carbon tetrachloride to the hydrogenation zone in a concentration of 0.01–1% by volume (HCl equivalent) with respect to the total gaseous phase. The zone contains a catalyst based on a noble metal and operates between 93° C. and 538° C. at 1–300 atm. In the treated feeds, the aromatic compounds are essentially monocyclic and are thus mainly kerosines. Comparative examples III–VI demonstrate that that process does not work at all well $CC_4$.

U.S. Pat. No. 3 639 227 also shows that the addition of chlorine to a hydrogenation zone improves the reaction yield in the presence of a catalyst containing a noble metal and about 0.3% of chlorine but containing no fluorine. The quantities of chlorine added, in particular when using $C_3H_6Cl_2$, are in the region of 0.6%. The feeds which can be treated are kerosines or spirits containing at most 0.5% of sulphur.

SUMMARY OF THE INVENTION

We have sought to improve hydrogenation processes for aromatic compounds to enable a chlorinating agent other than $CCl_4$ to be used and to be able to treat cuts which are heavier than kerosines, containing essentially polycyclic aromatic compounds.

The process for the hydrogenation of aromatic compounds of the invention takes place in the presence of a supported catalyst based on at least one noble metal and containing at least 1% by weight of at least one halogen, at a temperature of 200°–450 C., a pressure of 1–25 MPa, at an hourly space velocity (HSV) of 0.1–10 $h^{-1}$ and a hydrogen/feed volume ratio of 100–2000, and is carried out in the presence of chlorine injected at a concentration of 0.5–500 ppm by weight with respect to the feed.

The treated feed has an initial boiling point of more than 100° C., advantageously at least 150° C. and preferably at least 200° C. It may be a kerosine, a gas oil or a heavier feed, for example a 380°–550 C. cut.

The concentration of aromatic compounds in the feed is at least 10% by weight, preferably 20% by weight. The aromatic compounds preferably contain 1 to 6 rings, preferably 1 to 4. 200° $C.^{+}$cuts contain essentially polycyclic aromatic compounds (2–6 rings or 2–4 rings).

The feed contains 5–2000 ppm by weight of sulphur, preferably 50–800 ppm. The feed is preferably an atmospheric gas oil from catalytic cracking or a vacuum distillate which has already been treated which is to be turned into a food grade product.

Chlorine is injected, for example in the form of an organic compound, into the catalyst to increase its hydrogenating activity. The concentration of chlorine injected into the reactor is preferably 0.5–150 ppm, advantageously 5–70 ppm. Injection can be made into any region of the unit from the moment that the chlorine or chlorinated compound passes over the catalyst. Preferably, it is injected into the feed. Injection can be continuous or discontinuous. If it is continuous, the concentration of chlorine injected can be low. If it is discontinuous, the aim is to inject a relatively high concentration of chlorine for a period such that the desired hydrogenating activity is reached. Chlorine injection is then stopped, resulting in a drop in activity. When the minimum activity is reached, chlorine is injected again until the desired activity is again reached, and so on.

Examples of the chlorinated compound are dichloromethane, trichloromethane, dichloroethane, trichloroethane, tetrachloroethylene, hexachloroethane and chloroform.

The catalyst preferably contains only one noble metal. More preferably, the noble metal is platinum. The noble metal is deposited on a support with a large surface area (more than 100 $m^2/g$). This can be constituted by alumina, silica, silica-alumina, zeolite or any combination of two or more of these substances. The supports are firstly halogenated so that the final catalyst contains at least 1% by weight of at least one halogen. The catalyst preferably contains chlorine, and advantageously chlorine and fluorine. The support is preferably a chlorinated and fluorinated alumina.

The reaction temperature is preferably in the range 240° C. to 350° C., the pressure is in the range 1.5 MPa (15 bar) to 1 MPa (100 bar), the HSV is in the range 0.5 $h^{-1}$ to 2 $h^{-1}$ and the hydrogen/feed volume ratio is in the range 125 to 1000.

The following examples illustrate features of the invention without in any way limiting its scope.

EXAMPLE 1

Preparation of a Pt/alumina+Cl+F catalyst

The method used consisted of successively introducing the elements in excess in solution. Chlorine was introduced first, then fluorine and finally, platinum. The alumina was a gamma-cubic type alumina. The alumina was treated successively with a hydrochloric acid solution containing 2% of chlorine for 30 minutes to produce a good quantity of chlorine on the support. After draining off the solution, a hydrofluoric acid solution was brought into contact with the chlorinated support for 1 h 30. The support was then rinsed and the platinum was impregnated using hexachloroplatinic acid. After 12 hours of exchange, the catalyst was dried in dry air for two hours at 530° C. The composition of the catalyst was as follows:

Chlorine: 0.98% by weight

Fluorine: 1.03% by weight

Platinum: 0.60% by weight

EXAMPLE 2

Description of the two feeds used

Table 1 below shows the characteristics of a light cycle oil (LCO) type feed which was used to prepare two desulphurized feeds, one with a high sulphur content (DLCO1 ) and the other with a low sulphur content (DLCO2).

The density at 20°C. reduced along with the sulphur and nitrogen content. It should be noted that desulphurization of LCO was only accompanied by limited hydrogenation of the aromatic compounds since the AC measured by NMR only varied slightly, as did the aromatic compound concentrations measured using mass spectrometry.

TABLE 1

| Characteristics | LCO feed | DLCO1 feed | DLCO2 feed |
|---|---|---|---|
| Density at 20° C. | 0.945 | 0.904 | 0.893 |
| Sulphur (ppm) | 21800 | 109 | 9 |
| Nitrogen (ppm) | 625 | 132 | 5 |
| D86 (C) | | | |
| IBP | 173 | 166 | 139 |
| 10% | 229 | 210 | 208 |
| 50% | 285 | 266 | 265 |
| 90% | 355 | 343 | 332 |
| EP | 423 | 415 | 400 |
| Aromatics (wt %) | | | |
| Total | 80 | 74 | 69 |
| Mono | 17 | 44 | 48 |
| Di | 39 | 27 | 19 |
| Tri | 11 | 3 | 2 |
| AC by NMR | 55 | 43 | 36 |

EXAMPLE 3

Description of operating conditions for catalytic tests and catalyst activation conditions The catalysts described in the preceding examples were evaluated during a catalytic test using the following operating conditions:

Reactor type: up-flow

Total pressure: 60 bar $H_2$/feed ratio(1/1) : 450 Nl/Nl

HSV: 1 $h^{-1}$

Feed: see example

Temperature: see example

The catalyst had to be reduced before use. Following introduction into the reactor, a stream of hydrogen at 450° C. was passed over the catalyst for two hours to effect reduction. An ex-situ reduction method would have had the same effect.

EXAMPLE 4

Comparison of the influence of the same quantity of chlorine on a feed with a high sulphur concentration and on a feed with a low sulphur concentration We evaluated the influence of addition of chlorine to the catalyst of Example A (Pt/alumina+Cl+F type catalyst). We measured the catalytic performances using a feed DLCO1 containing a high concentration of sulphur and a feed DLCO2 containing a low concentration of sulphur. The two feeds are described in Example 2.

The results are shown in Table 2 below. For each experiment, we measured the density of the liquid effluent at 20° C., the AC concentration (Aromatic Carbon measured by NMR) of the effluent and the initial concentration $AC_0$ in the feed.

TABLE 2

| | DLCO1 | | DLCO2 | |
|---|---|---|---|---|
| | no addition | addition | no addition | addition |
| Temperature (°C.) | 280 | 280 | 250 | 250 |
| Chlorine added (ppm) | 0 | 50 | 0 | 50 |
| Density at 20° C. | 0.870 | 0.881 | 0.863 | 0.867 |
| Initial AC, feed | 43 | | 36 | |
| AC effluent | 27.4 | 19.8 | 26.7 | 24.7 |
| % HDAC | 36.3 | 53.9 | 25.7 | 31.4 |
| Activity | 0.451 | 0.774 | 0.297 | 0.377 |
| Relative activity | 100 | 171 | 100 | 127 |

Using the AC of the feed and the AC of the effluent, we calculated the conversion (% HDAC) then the hydrogenating activity assuming it to be first order. It appears that, for the same quantity of chlorine added, the gain in activity is greater when the sulphur content in the feed is higher.

We claim:

1. A process for the hydrogenation of aromatic compounds in a feed, said feed having an initial boiling point of more than 100 C. and which contains at least 10% by weight of aromatic compounds, in the presence of a supported catalyst consisting essentially of at least one noble metal and at least 1% by weight of at least one halogen incorporated as a chlorinated and fluorinated support, at a temperature of 200°–450° C., a pressure of 1–25 MPa, at an hourly space velocity (HSV) of 0.1–10 $h^{-1}$ and a hydrogen/feed volume ratio of 100–2000, in which the process is carried out in the presence of chlorine injected into the hydrogenation zone at a concentration of 0.5–500 ppm by weight with respect to the feed.

2. A process according to claim 1, in which the feed contains 5–2000 ppm by weight of sulphur.

3. A process according to claim 1, in which the feed contains 50–800 ppm by weight of sulphur.

4. A process according to claim 1, in which the aromatic compounds in the feed essentially contain 2–6 aromatic rings.

5. A process according to claim 1, in which the feed has an initial boiling point of at least 200° C.

6. A process according to claim 1, in which the feed is an atmospheric gas oil or a vacuum distillate.

7. A process according to claim 1, in which a chlorinated organic compound is injected which is selected from the group consisting of dichloromethane, trichloromethane, dichloroethane, trichloroethane, tetrachloroethylene, hexachloroethane, and chloroform.

8. A process according to claim 1, in which the chlorine is injected into the feed.

9. A process according to claim 1, characterized in that the catalyst consists essentially of platinum deposited on a chlorinated and fluorinated alumina.

10. A process according to claim 9, wherein the initial boiling point of the feed is at least 150° C.

11. A process according to claim 9, wherein the initial boiling point of the feed is at least 200° C.

12. A process according to claim 11, wherein the concentration of aromatic compounds in the feed is at least 20% by weight.

13. A process according to claim 12, in which the feed contains 50–800 ppm by weight of sulphur.

14. A process according to claim 12, wherein the concentration of chlorine is 0.5–150 ppm.

15. A process according to claim 13, wherein the concentration of chlorine is 5–70 ppm.

16. A process according to claim 1, wherein the concentration of chlorine is 0.5–150 ppm.

17. A process according to claim 1, wherein the concentration of chlorine is 5–70 ppm.

18. A process for the hydrogenation of aromatic compounds in a feed, said feed having an initial boiling point of at least 200° C. and containing at least 10% by weight of polycyclic aromatic compounds, in the presence of a supported catalyst based on at least one noble metal and containing at least 1% by weight of at least one halogen, at a temperature of 200–450° C., a pressure of 1–25 MPa, at an hourly space velocity (HSV) of 0.1–10 $h^{-1}$ and a hydrogen/feed volume ratio of 100–2000, in which the process is carried out in the presence of chlorine injected into the hydrogenation zone at a concentration of 0.5–500 ppm by weight with respect to the feed.

19. A process according to claim 18, wherein said feed contains at least 20% by weight of polycyclic aromatic compounds.

20. A process according to claim 19, characterized in that the catalyst contains a chlorinated and fluorinated support.

21. A process according to claim 18, in which the feed contains 5–2000 ppm by weight of sulfur.

22. A process according to claim 18, in which the feed contains 50–800 ppm by weight of sulphur.

23. A process according to claim 18, wherein the feed is a 380–550° C. cut.

* * * * *